US009602904B2

(12) United States Patent
Sutton, III

(10) Patent No.: US 9,602,904 B2
(45) Date of Patent: Mar. 21, 2017

(54) PORTABLE BEVERAGE COOLER SUPPORT

(71) Applicant: Albert J. Sutton, III, Princeton, NJ (US)

(72) Inventor: Albert J. Sutton, III, Princeton, NJ (US)

( * ) Notice: Subject to any disclaimer, the term of this patent is extended or adjusted under 35 U.S.C. 154(b) by 0 days.

(21) Appl. No.: 14/828,683

(22) Filed: Aug. 18, 2015

(65) Prior Publication Data

US 2016/0061512 A1 Mar. 3, 2016

Related U.S. Application Data

(60) Provisional application No. 62/043,549, filed on Aug. 29, 2014.

(51) Int. Cl.

| | |
|---|---|
| ***A47B 85/00*** | (2006.01) |
| ***H04R 1/02*** | (2006.01) |
| ***A47B 3/10*** | (2006.01) |

(52) U.S. Cl.

CPC ..... *H04R 1/028* (2013.01); *A47B 3/10* (2013.01)

(58) Field of Classification Search

CPC .... A47B 3/10; A47B 5/00; A47B 5/06; A47B 83/045; H04R 1/028

USPC ..... 108/25, 26, 36, 35, 24, 27, 38, 50.11, 34

See application file for complete search history.

(56) References Cited

U.S. PATENT DOCUMENTS

| | | | | | |
|---|---|---|---|---|---|
| 2,021,530 | A | * | 11/1935 | Tyler | A47J 43/00 108/24 |
| 2,059,957 | A | * | 11/1936 | Mendenhall | A61G 13/105 108/173 |
| 2,709,631 | A | * | 5/1955 | Covucci | A47B 3/087 108/167 |
| 2,862,777 | A | * | 12/1958 | Paige | A47B 3/083 108/34 |
| 3,279,399 | A | * | 10/1966 | White | A45C 9/00 108/38 |
| 3,878,797 | A | * | 4/1975 | Patterson | A47B 13/081 108/36 |
| 4,184,451 | A | | 1/1980 | Carlin | |
| 4,375,758 | A | * | 3/1983 | Simmons | F25D 3/06 62/457.1 |
| 5,056,439 | A | * | 10/1991 | Hodge, Jr. | A47B 3/04 108/34 |
| 5,454,575 | A | | 10/1995 | Del Buono | |
| 5,480,170 | A | | 1/1996 | Kaiser, II | |

(Continued)

*Primary Examiner* — Jose V Chen

(74) *Attorney, Agent, or Firm* — Gearhart Law LLC

(57) ABSTRACT

A portable beverage cooler support has a support base and a least one support leg coupled thereto. The support base is sized to be receptive to at least one beverage cooler. A removable partition may be used to adjust the support base to multiple sized beverage coolers or provide a reinforced space between multiple beverage coolers. A lip or extension surrounds the support base wholly or in part to help retain any number of beverage coolers upon the support base. The beverage cooler(s) may further be secured in place by adjustable support straps that attach to the beverage cooler and the portable beverage cooler support. The portable beverage cooler support may bear the logo and colors of a sports team or other branding, patterns, textures, and the like. In some instances, the portable beverage cooler has at least one wireless speaker that may function with any number of wireless devices.

9 Claims, 7 Drawing Sheets

(56) References Cited

U.S. PATENT DOCUMENTS 5,572,934 A * 11/1996 Aldridge ..... A47B 37/00 108/24
5,979,337 A 11/1999 Clark et al.
6,068,355 A 5/2000 Thorp
6,192,809 B1 * 2/2001 Riach ..... A47B 3/087 108/115
6,328,179 B1 12/2001 Conrado et al.
6,389,624 B1 5/2002 Madole
6,796,319 B1 9/2004 Patarra et al.
6,997,111 B2 2/2006 Giegerich
7,128,369 B2 10/2006 Boggs et al.
7,252,040 B2 8/2007 Dumond
7,341,164 B2 3/2008 Barquist et al.
7,347,442 B1 3/2008 Carter
7,451,709 B2 11/2008 Swartfager et al.
7,730,841 B2 * 6/2010 Wang ..... A47B 13/12 108/153.1
8,188,410 B2 * 5/2012 Dean ..... A47B 3/0911 108/115
8,245,338 B1 8/2012 Nemeth
8,479,663 B2 * 7/2013 Davis ..... A47B 3/10 108/35
8,480,114 B1 7/2013 Grantz
8,484,779 B1 * 7/2013 Bradwell ..... A61G 13/0027 108/24
8,490,551 B1 * 7/2013 Wagner ..... A47B 31/04 108/24
8,739,335 B1 6/2014 Hoggatt
2005/0109245 A1 * 5/2005 Pote ..... A47B 37/00 108/25
2006/0219580 A1 * 10/2006 Lown ..... A47B 3/0912 206/225
2007/0256608 A1 * 11/2007 Chen ..... A45C 15/00 108/50.11
2007/0260348 A1 11/2007 Gordils
2008/0022904 A1 * 1/2008 Matheus ..... A47B 3/002 108/38
2008/0134946 A1 6/2008 Alonso et al.
2009/0211496 A1 * 8/2009 Davis ..... A47B 3/10 108/50.11
2009/0276319 A1 * 11/2009 Lungu ..... G06Q 30/02 705/14.73
2010/0015882 A1 1/2010 Givens
2012/0090511 A1 4/2012 Underwood et al.
2014/0285959 A1 * 9/2014 Riley ..... A47B 21/0073 361/679.08
2016/0174744 A1 * 6/2016 Bawden ..... A47G 23/0306 108/50.11

* cited by examiner

PORTABLE BEVERAGE COOLER SUPPORT

CLAIM OF PRIORITY

This application claims the priority of U.S. Ser. No. 62/043,549 filed on Aug. 29, 2014, the contents of which are fully incorporated herein by reference in its entirety.

FIELD OF THE EMBODIMENTS

The field of the invention and its embodiments relate to support devices for holding or supporting an item in an elevated position, namely at least one beverage cooler. In particular, the present invention and its embodiments relate to a beverage cooler support that securely supports a beverage cooler in an elevated position.

BACKGROUND OF THE EMBODIMENTS

Coolers are typically known by a number of different names depending on your age and location such as beverage cooler, ice box, ice chest, and cool box. Even though the names may vary, these devices primarily serve the same function by keeping one's food and drink cold by insulating the interior of the cooler from the external environment and elements.

Generally coolers are designed to be placed on the ground and accessed by an individual as desired. However, by placing the cooler on the ground, the cooler often collects dirt, dust, and debris which needs to be cleaned off. At times, coolers can have condensation form on their exterior surfaces. Now instead of cleaning dust, dirt, and other grime, one must clean wet grass, mud, and the like or risk soiling their clothes, automobile interior, or home. Some individuals combat this by placing a towel or similar absorbent device underneath the cooler. However, the towel then becomes saturated with condensation and grime and must be washed. Further, towels provide ample opportunity for insects and the like to hide and be brought into the home or automobile.

To combat this problem, in some instances, individuals have integrated extendable legs into a cooler in order to enable the cooler to be positioned above the ground. While this may solve at least one problem, it gives rise to a number of other issues. For example, the cooler's higher center of gravity make it easier to tip over and spill it contents or to cause injury to another. Further, the condensation from such coolers may pool and collect around the area underneath the cooler providing for slippery conditions or again necessitating the need for a towel or absorbent padding.

Additionally, there are a number of people for whom coolers are not easily accessed. For example, the elderly or people with physical ailments, especially of the back, often have a hard time bending over to pick up an object. Traditional coolers are sized and located as such that they often are situated at or below a person's knee. This requires some type of bending on the body in able to be in a position to access the cooler. This, in turn, often requires these people to rely on others to retrieve items from a cooler or have to go without the item sought.

Thus, there is a need for a cooler support apparatus that effectively and safely positions a cooler in an elevated position. Additionally, the cooler support should be able to provide support for at least one and preferably multiple coolers. Further, the cooler support apparatus should be able to prevent the buildup of condensation on the ground thereby leading to unsafe conditions for persons and animals alike. The present invention and its embodiments meet and exceed these objectives.

Review of Related Technology:

U.S. Pat. No. 7,451,709 pertains to a portable cooler and table assembly that may be easily transported in a single, self-contained unit. The assembly may be converted for use as a table for a variety of recreational activities, e.g., dining, drinking, games such as ping pong, beer pong, table hockey, card games, board games, preparation for sporting events and meals. The table and cooler may be permanently attached to each other, or alternatively, the cooler may be detachable from the table. The table may fold or collapse to assist in converting the assembly from a compact, light-weight transportable unit into a fully extended and operable table and cooler. The table surface may contain surface features such as grooves, indentations, nets, game pieces, etc. The cooler may comprise any container that is capable of containing ice or some other refrigeration or heating system, e.g., a conventional 54 quart beverage cooler. Alternatively, the cooler may be replaced with a storage container or other storage device. The assembly may also contain various wheels, legs and handles to assist in mobility and conversion.

U.S. Pat. No. 7,341,164 pertains to an ice chest that has retractable, telescoping legs extending at respective forward and rearward angles from each respective end wall of the ice chest. The ice chest has handles at the upper central portion of the ice chest end wall having push buttons therein which release the telescoping legs from a locked position and which fall to the open position under their own weight and lock in a secure position. The push buttons actuate the locks by a linkage system. The front legs have pads at their lower ends, protecting the ends of the legs, and providing weight to pull the legs into the open, locked position. The rear legs have wheels which also providing weight to pull the legs into the open, locked position. A similar water cooler has retractable legs which have pads on their lower ends pulling the legs downward upon pushing buttons on handles on the sidewalls.

U.S. Pat. No. 5,454,575 pertains to a system for receiving and supporting a child car seat comprising a dolly having a rectangular support plate with a rectangular opening of a size and shape to receive the lower surface of a child car seat, the support plate having interleaved webbing at the lower extent of the opening for providing support to a child car seat located thereabove; securement means in the form of a strap and buckle secured to the side edges of the support plate adapted to releasably couple a child car seat to the support plate; a plurality of legs, the legs arranged in two pair including a first pair of legs pivotally secured at their upper ends to the opposed edges of the support plate; the second pair of legs slidably secured at their upper ends to other opposed edges of the support plate, a slidable coupling including tubular sleeves pivotally coupled to the support plate with the upper ends of the second pair of legs slidably received therein, the second legs each comprising a release button for retaining the sleeve at the upper end of the second legs and the legs in an extended operative orientation, the buttons adapted to be depressed to allow the second pair of legs to slide within the sleeves for movement to a collapsed orientation.

U.S. Patent Application 2007/0260348 pertains to a combination portable table and carrier device for transporting and reading construction plans (e.g. blueprints). The device includes a table having a plan storage compartment for holding one or more sets of construction plans in a flat or folded position. The storage compartment is flush with the surface of the table thus enabling the construction plans to be written on without problems from the underlying surface. A lid is hinged to the storage compartment and the table thus providing access to the storage compartment when open and a smooth work surface for the table when closed. The lid also protects the contents of the storage compartment when it is closed. Binder clips at opposite ends of the portable secure the set of construction plans in place for viewing and modification. The binder clips holds the turned pages of the plans, thereby permitting individual pages of the plans to be easily viewed while the entire set of plans is secured in place and held open to the selected page.

Various devices are known in the art. However, their structure and means of operation are substantially different from the present disclosure. The other inventions fail to solve all the problems taught by the present disclosure. The present invention and its embodiments provide for supporting a beverage cooler in an elevated position with repositionable holding areas and an anchored base. Further, the present invention provides a simple and effective way to remove condensation, debris, and the like from the apparatus. At least one embodiment of this invention is presented in the drawings below and will be described in more detail herein.

SUMMARY OF THE EMBODIMENTS

The present invention and its embodiments describe and teach a support for a beverage cooler or other item(s) that reduce mess and makes it easier to access and retrieve items from a beverage cooler. Thus, a portable beverage cooler support is described and taught having a support base, wherein the support base has at least one support drain; a least one support leg; at least one removable partition adapted to be removably coupled to the support base; at least two support straps; and a vertical extension extending vertically upwards partially or wholly from a perimeter of the support base.

Preferably, the portable beverage cooler has more than one support leg and up to four support legs, although the exact number of supporting structures (legs) may vary with the dimensions of the support base. To provide further rigidity to the structure there may be lateral members positioned between and attached to the support legs.

Once a beverage cooler is placed upon the support base, a removable partition can be used to prevent movement of the beverage cooler by positioning a removable partition on at least one side of the beverage cooler. Support straps at then used to secure the beverage cooler to the support base via slots or other structures of the portable beverage cooler support. Further, a number of ground anchors or stakes may be used to further secure the apparatus as a whole.

In another embodiment there is a portable beverage cooler support having a support base with a perimeter and a first end and a second end, wherein the support base has at least one support drain; four support legs with two of the support legs being coupled to the support base at the first end of the support base and two of the support legs being coupled to the support base at the second end of the support base, wherein the four support legs are independently adjustable; at least one removable partition adapted to be removably coupled to the support base; at least one ground anchor coupled to the support base via a length of at least semi-flexible material; at least two adjustable support straps having a first end and a second end, wherein there is a securement mechanism attached to each of the first end and the second end of the at least two support straps; and a vertical extension extending vertically upwards wholly around the perimeter of the support base.

The portable beverage cooler support may have any combination of logos, characters, writing, patterns, textures, symbols, insignia, colors, or images on any part of the apparatus. For example, the logos and color patterns of a sports team may be reflected on the apparatus.

The portable beverage cooler may have a carrying handle to increase the ease of portability of the apparatus. Further, the support base, depending on the size, may have two separate sections that are hingeably coupled to one another. By bringing the two sections together, the portable beverage cooler support may be able to be conveniently transported and stowed.

To combat some of the issues noted with existing portable coolers, the portable beverage cooler support may further have a removable liner sized to fit the support base. The liner may also be sized to fit a particular size beverage cooler rather than the base. This liner can prevent the buildup or leakage of condensation in undesirable places thereby helping to prevent messes and/or injury from slippage.

In yet another embodiment of the present invention there is a portable beverage cooler support having a support base with a perimeter and a first end and a second end, wherein the support base has at least one support drain; four support legs with two of the support legs being coupled to the support base at the first end of the support base and two of the support legs being coupled to the support base at the second end of the support base, wherein the four support legs are independently adjustable; at least one removable partition adapted to be removably coupled to the support base; at least one ground anchor coupled to the support base via a length of at least semi-flexible material; at least two adjustable support straps having a first end and a second end, wherein there is a securement mechanism attached to each of the first end and the second end of the at least two support straps; a vertical extension extending vertically upwards wholly around the perimeter of the support base; and at least one wireless speaker. The wireless speaker may wirelessly pair, or couple, to any number of electronic devices and may further be powered by a power source.

In general, the present invention succeeds in conferring the following, and others not mentioned, benefits and objectives.

It is an object of the present invention to provide a portable beverage cooler support that can support any number of beverage coolers.

It is an object of the present invention to provide a portable beverage cooler support that supports any number of beverage coolers at an elevated position.

It is an object of the present invention to provide a portable beverage cooler support that reduces or eliminates the mess associated with placing a beverage cooler on the ground.

It is an object of the present invention to provide a portable beverage cooler support that is readily portable and lightweight.

It is an object of the present invention to provide a portable beverage cooler support that is inexpensive.

It is an object of the present invention to provide a portable beverage cooler support that is durable and resilient.

It is another object of the present invention to provide a portable beverage cooler support that safely and effectively support a beverage cooler.

It is yet another object of the present invention to provide a portable beverage cooler support that secures the beverage cooler in an upright position.

It is yet another object of the present invention to provide a portable beverage cooler support that is easy to use by all ages and physical ability levels.

It is yet another object of the present invention to provide a portable beverage cooler support that organizes a variety of items and stows them neatly.

DESCRIPTION OF THE PREFERRED EMBODIMENTS

Figure 1:
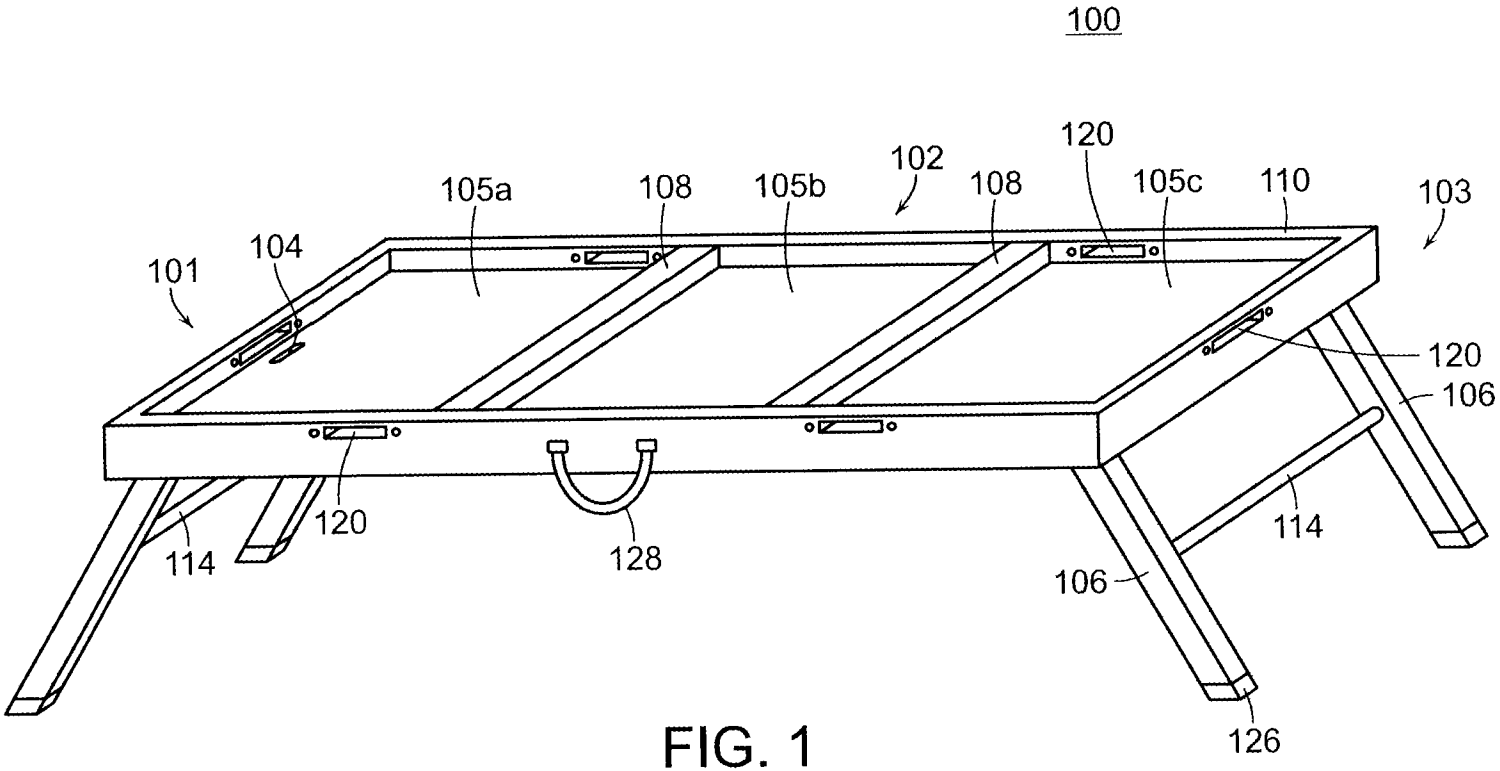
FIG. 1 is a perspective view of an embodiment of the present invention in a functional position.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, there is a portable beverage cooler support 100 in accordance with at least one embodiment of the present invention. The portable beverage cooler support 100 generally has a support base 102 and at least one support leg 106. Preferably, there are four support legs 106 with the four support legs 106 divided into two pairs of legs with one pair positioned at a first end 101 of the support base 102 and the other pair positioned at a second end 103 of the support base 102.

The support legs 106 are rotatably coupled to the support base 102. The support legs 106 may be rotated under the support base 102 to be placed in a storage position (see FIG. 6A) or may be positioned to support the support base 102 by being outwardly rotated from their storage position. The angle of rotation of the support legs may vary, but is preferably such that the support legs 106 provide adequate support for the support base 102 and any items contained thereon. Typically, such a foundation is created when the support legs 106 are rotated to form an angle, with respect to the support base 102, of greater than 90°. However, as noted, the formed angle between the support base 102 and the support legs 106 may vary and may require a locking mechanism 122 (see FIG. 7) to ensure proper support position.

Further, the support legs 106 are preferably partially or wholly coated in a non-slip material 126. This non-slip material 126 allows the portable beverage cooler support 100 to be placed on a variety of terrain without comprising the support provided by the support legs 106. In some instances, the support legs 106 have a lateral member 114 extending between each pair of the supports legs 106. This lateral member 114 provides further support by reducing the independent movement of one of the support legs 106 and preventing tipping of the portable beverage cooler support 100 which may result in injury. In some instances, see FIG. 7, there is not lateral member(s) 114 enabling independent rotation of each support leg 106 rather than rotation of pairs of support legs 106.

The support base 102 may have varying dimensions but generally bears a rectangular shape with a vertical extension 110 extending wholly are partially around the perimeter of the support base 102. The vertical extension 110 may have slots 120 for coupling any number of beverage coolers 124 to the support base 102 (see FIG. 2). The number of slots 120 and the positions of the slots 120 may vary as required. Additionally, the slots 120 may have varying shapes as shown in FIG. 1. This enables the slots 120 to have different types of attachment mechanisms affixed thereto (i.e. clamps, hooks, etc.).

The interior area of the support base 102 may be partitioned by any number of removable partitions 108. These removable partitions 108 are adapted to be removably coupled to the support base 102. Thus, any suitable mechanism may be used to achieve such coupling including but not limited magnets, snaps, locks, fasteners, tabs, grooves, pins, screws, tacks, and the like or any combination thereof. Each of the removable partitions 108 can be used to create support areas 105*a*, 105*b*, and 105*c* where an item may be positioned and further secured to the support base 102. The removable partitions 108, themselves, made be made from any suitable material including but not limited to plastics, metals, composites, resins, rubbers, and the like or any combination thereof.

The support base 102 further may have a support drain 104 which may be used to rid the interior of the support base 102 of excess moisture and particulates. The support drain 104 may have a cap 107 (see FIG. 4) or fitting that allows for the temporary retention of any such materials. The cap or fitting may be attached via any suitable mechanism including but not limited to threading and friction.

Additionally, the support base 102 may have a textured surface comprising various configurations of ridges, groves, bumps, and the like or any combination thereof. The textured surface may provide for easier movement of any item contained thereon and may help direct the flow of condensate present on the support base 102. A carrying handle 128 is also positioned on the support base 102 to enable the portable beverage cooler support 100 to be readily transportable. In some instances, there may be more than one handle or the handle may be removable.

Figure 2:
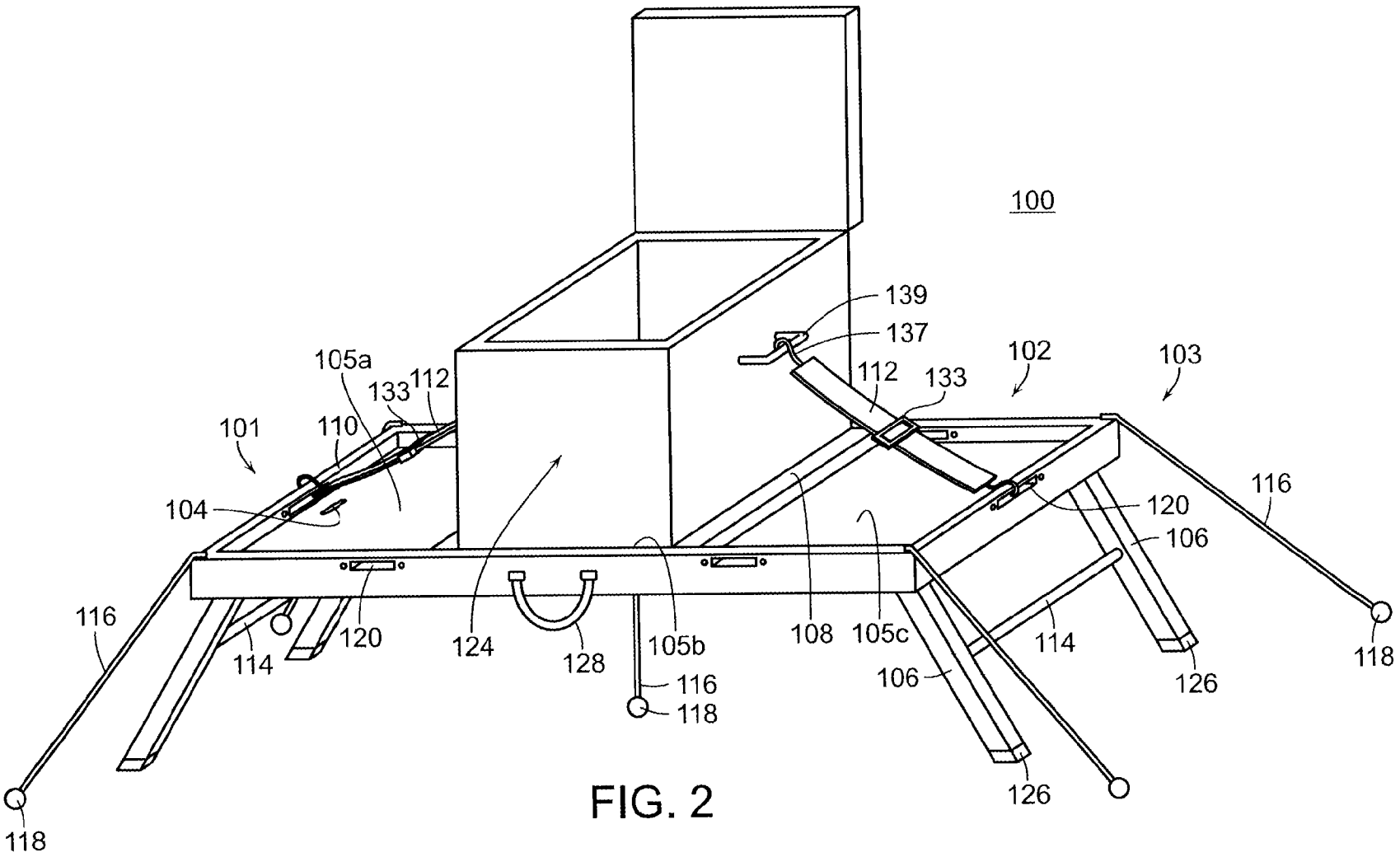
FIG. 2 is a perspective view of an embodiment of the present invention with a beverage cooler thereon and secured in position.

In FIG. 2, the portable beverage cooler support 100 is shown in use with a beverage cooler 124 positioned and secured thereon. The portable beverage cooler 124 is positioned in support area 105*b* and flanked on each side by either the vertical extension 110 or the removable partitions 108. These structures effectively "lock" the beverage cooler 124 in positioned upon the support base 102. The other supports areas 105*a*, 105*c* may be used to hold other beverage coolers 124 or cups, napkins, utensils, or the like or any combination thereof.

Attached to the beverage cooler handle(s) 139 is a support strap 112. The support strap 112 has a first end and a second end with a securement mechanism 137 thereon each of the ends.

Preferably, one end, either the first end or the second end, of the support strap 112 is secured to the beverage cooler handle 139 whereas the other end is secured to the slot 120 in the vertical extension 110. The support straps 112 are adjustable via an adjustment mechanism 133 that allows the length of the support straps 112 to be changed as necessary. In some instances, the support straps 112 may have each securement mechanism 137 attached to the beverage cooler handle 139 and have the length of the support strap 112 looped around and through the slot 120. The securement mechanism 137 is preferably a hook or hook like structure but may employ clamps, buckles, and the like or any combination thereof. In some instances, the beverage cooler 124 may not have any exterior handles providing a sufficient coupling surface. In this case, any of the other alternate measures, and those not mentioned, may be used.

In yet other instances, the support strap 112 is integrated into the support base 102 and retractably extends therefrom to secure the beverage cooler 124. The support straps 112 may have some elastic properties and may comprise but are not limited to natural and synthetic fibers including cotton, wool, polyester, silk, straws, grasses, rayon, nylon, acrylic, and polyolefin.

The portable beverage cooler support 100 may further include a number of ground anchors 118. The ground anchors 118 provide additional support for the portable beverage cooler support 100. The ground anchors 118 are connected to a length of material 116 that is preferably at least semi-flexible in nature. This may include various fibers, cables, wires, ropes, twines, strings, and the like or any combination thereof. The length of material 116 preferably extends from the support base 102 to the ground anchor 118 and may be a single mechanism or have differing components.

For example, the ground anchor 118 and length of material 116 may be removably attached to the support base 102 or may be permanently attached to the support base 102.

Further, each of the components may be made from a singular material or may have different compositions that are separable from one another. It is preferable that there are about four to about five ground anchors 118 with a length of material 116 extending therefrom and coupling the ground anchors 118 to the support base 102. These ground anchors 118 may be positioned on each of the four corners of the support base 102 and the underside (center) of the support base 102. This provides added support and securement to prevent the portable beverage cooler support 100 from tipping and spilling the contents of the beverage cooler 124 or causing property damage or personal injury.

Figure 3:
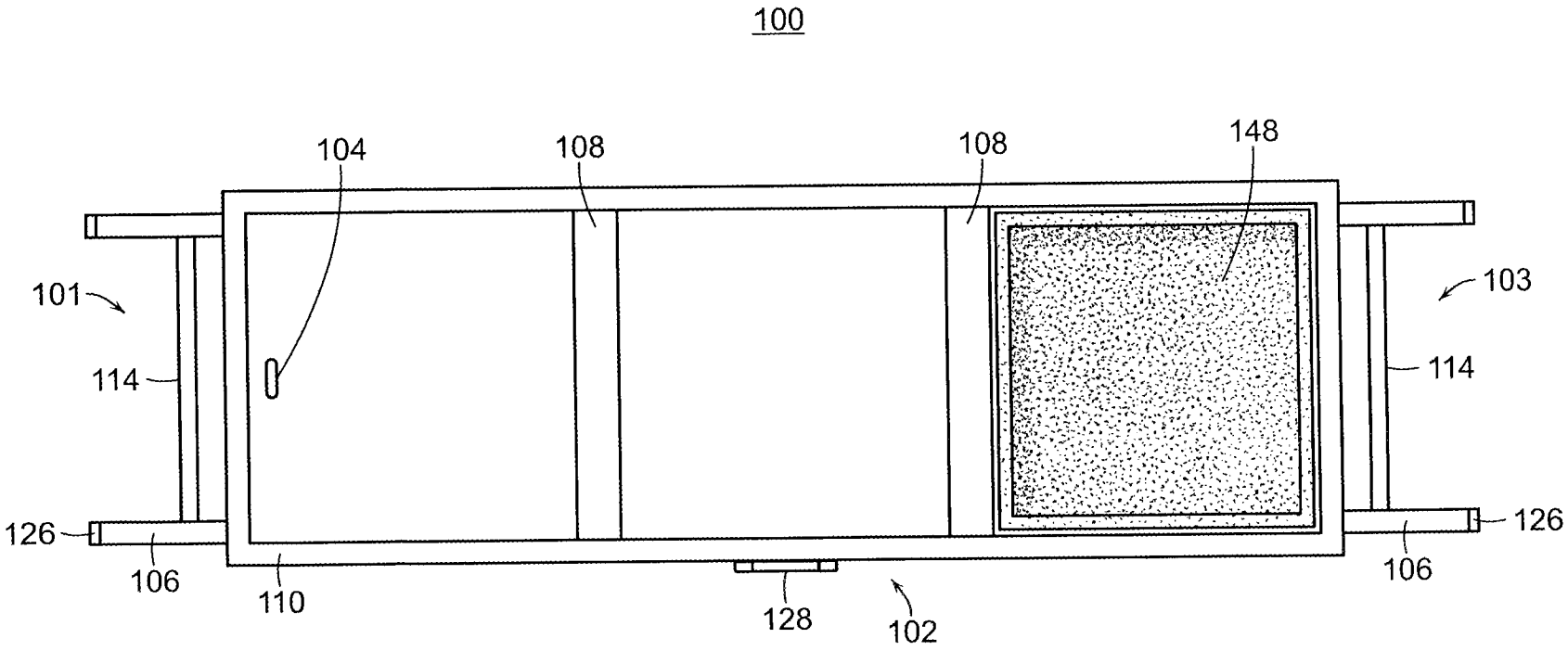
FIG. 3 is a top view of an embodiment of the present invention.
Figure 4:
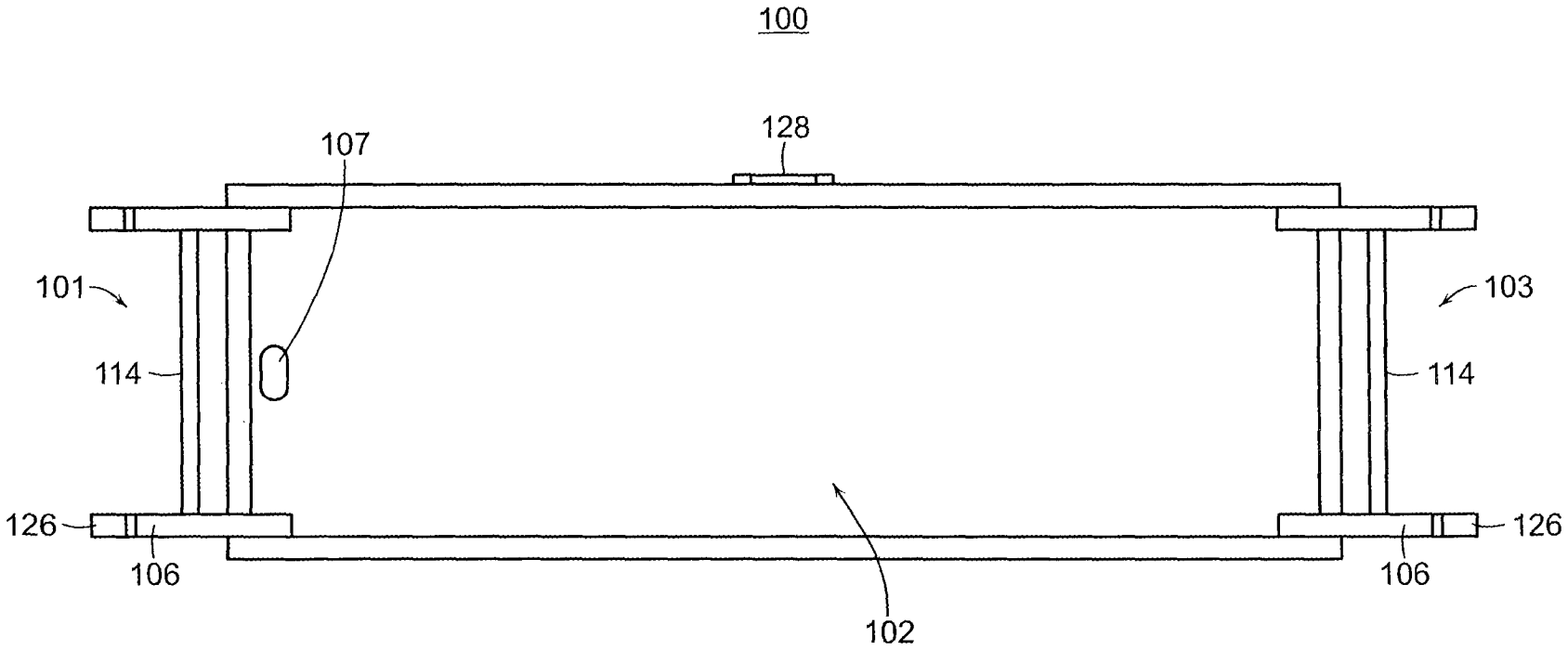
FIG. 4 is a bottom view of an embodiment of the present invention.
Figure 5:
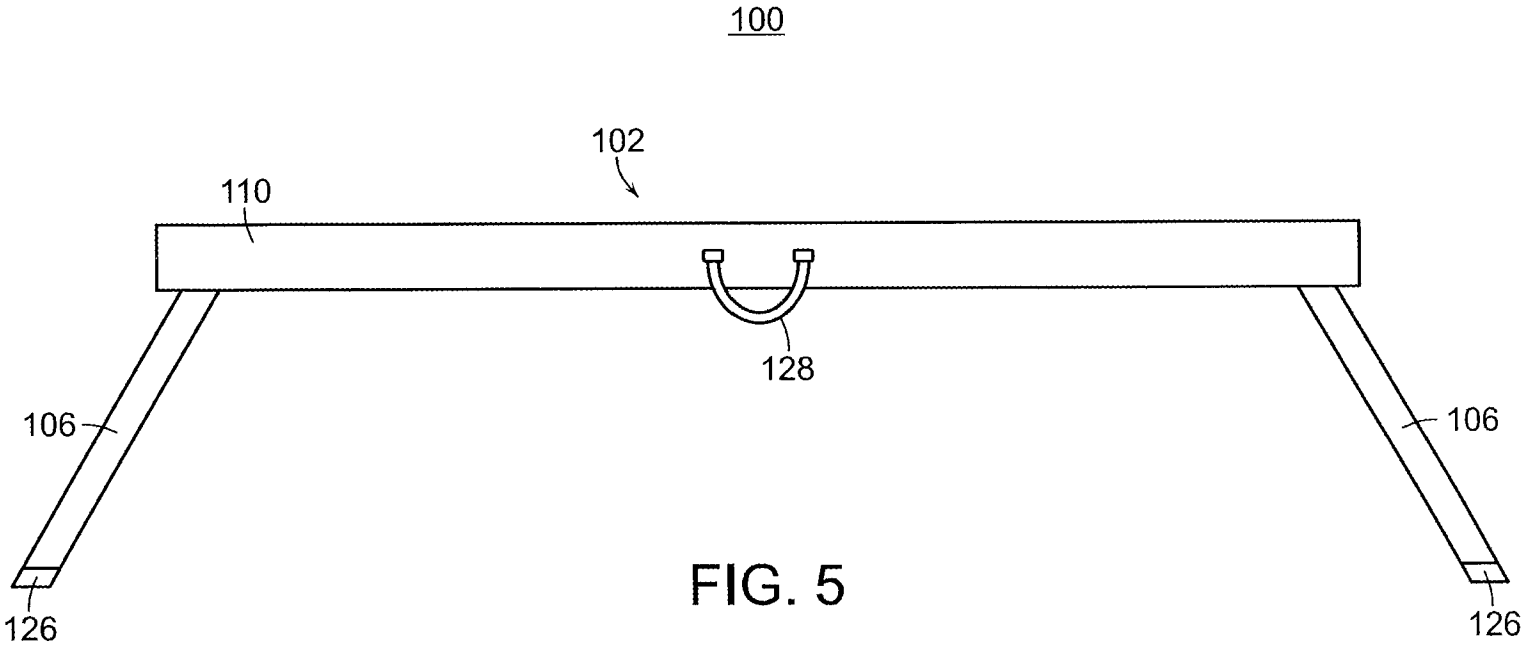
FIG. 5 is a side view of an embodiment of the present invention.

FIGS. 3-5 show differing views of the portable beverage cooler support 100 with the support legs 106 extended and the apparatus ready for use. In FIG. 3, there is a top view of the portable beverage cooler support 100. From this view the angle of the support legs 106 in relation to the support base 102 is apparent. There are two removable partitions 108 which has resulted in three different support areas. In one of the support areas, there is a removable liner 148. The removable liner 148 is preferably a thin, flexible, and at least water-resistant material that lines all or part of the support base 102 and multiple liners may be used in conjunction with one another. As shown, the removable liner 148 may fit into one of the support areas and is repositionable to any point of the support base 102.

One function of the removable liner 148 is to collect condensation or moisture or food (and other debris) particulates and make cleaning the portable beverage cooler support 100 quick and easy. The edges of the removable liner 148 may be bent upwards at some angle or have other mechanisms to promote retention of the aforementioned materials.

In FIG. 4, there is a bottom view of the portable beverage cooler support 100. The underside of the support base 102 is visible along with the connection points between the support legs 106 and the support base 102. The support drain 104, as seen in FIG. 3, has a drain cap 107 that may be attached through a number of mechanisms including threading and friction. The drain cap 107 prevents unwanted drainage of any moisture or solid material. Each of the support legs 106 are shown with a lateral member 114 extending therebetween. As noted, in some cases, there is no lateral member 114 and the legs move independent from one another.

From the side, as shown in FIG. 5, the support base 102 is generally planar in that it sits within the same place minus the vertical extension 110 surrounding some or all of the perimeter. The carrying handle 128 is positioned towards the midline of the portable beverage cooler support 100 so that the weight may be distributed evenly as possible. In some circumstances, the carrying handle may exist in duplicate or be set off center to accommodate differences in weight attributable to the first end 101 or the second end 103.

Figure 6A:
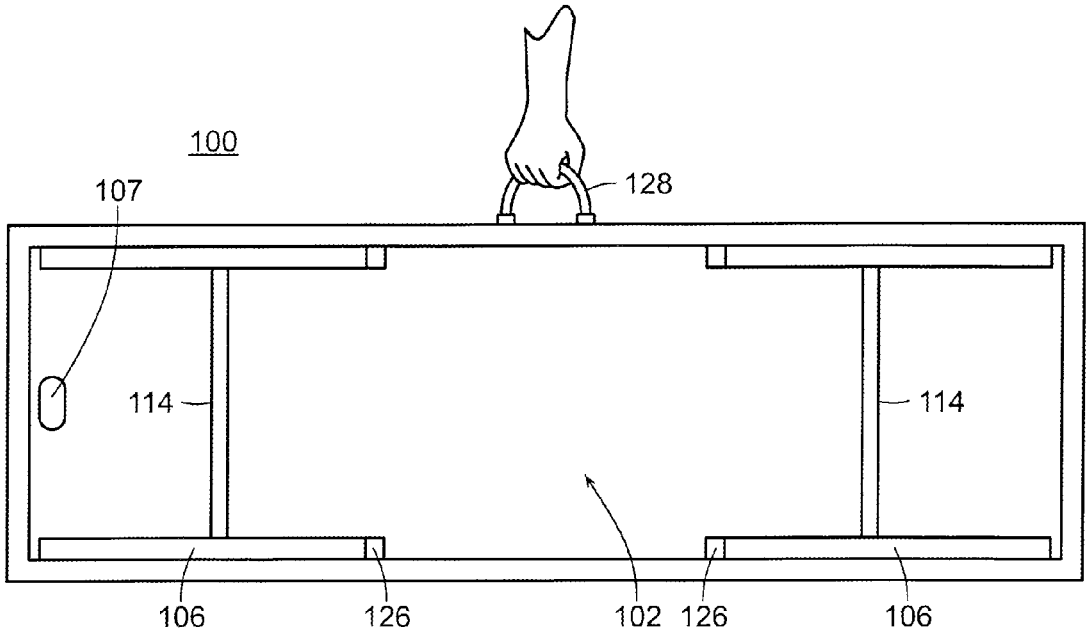
FIG. 6A is a perspective view of an embodiment of the present invention in a transporting position.
Figure 6B:
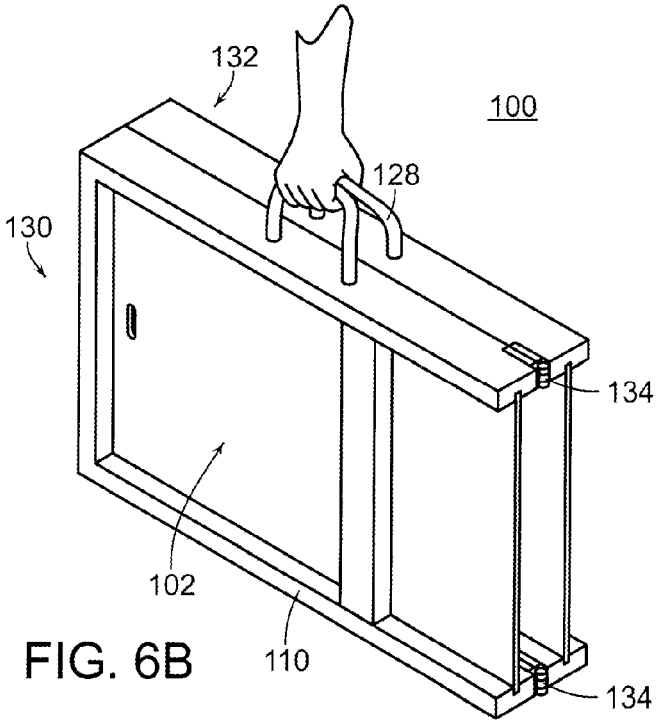
FIG. 6B is a perspective view of an embodiment of the present invention in an alternate transporting position.

In FIGS. 6A and 6B, the portable beverage cooler support 100 is shown in a transportation or storage position. In FIG. 6A, the portable beverage cooler support 100 is shown on its side and being carried by the carrying handle 128. The support legs 106 have been rotated inwards to lie substantially parallel with the support base 102. The support legs 106 may be positioned individually or in tandem when connected with the lateral member 114. This transportation position makes the portable beverage cooler support 100 easier to transport and prevent damage to the support legs, lateral member 114, or non-slip coating 126.

In FIG. 6B, the portable beverage cooler support 100 has been folded in half about at least one hinge 134. In this case, there may be two carrying handles 128 with one on each of the first section 130 of the support base 102 and one on the second section 132 of the support base 102. The support base 102 hinges and folds preferably leaving the upper surface of the support base 102 and the vertical extension 110 exposed thereby preventing damage to the support legs 106. However, in some instances it may be preferable to have the hinges 134 work in the opposite direction. In this manner of transportation and storage, the portable beverage cooler support 100 takes up substantially less space and may be easier to maneuver given the exact dimensions of the support base 102.

Figure 7:
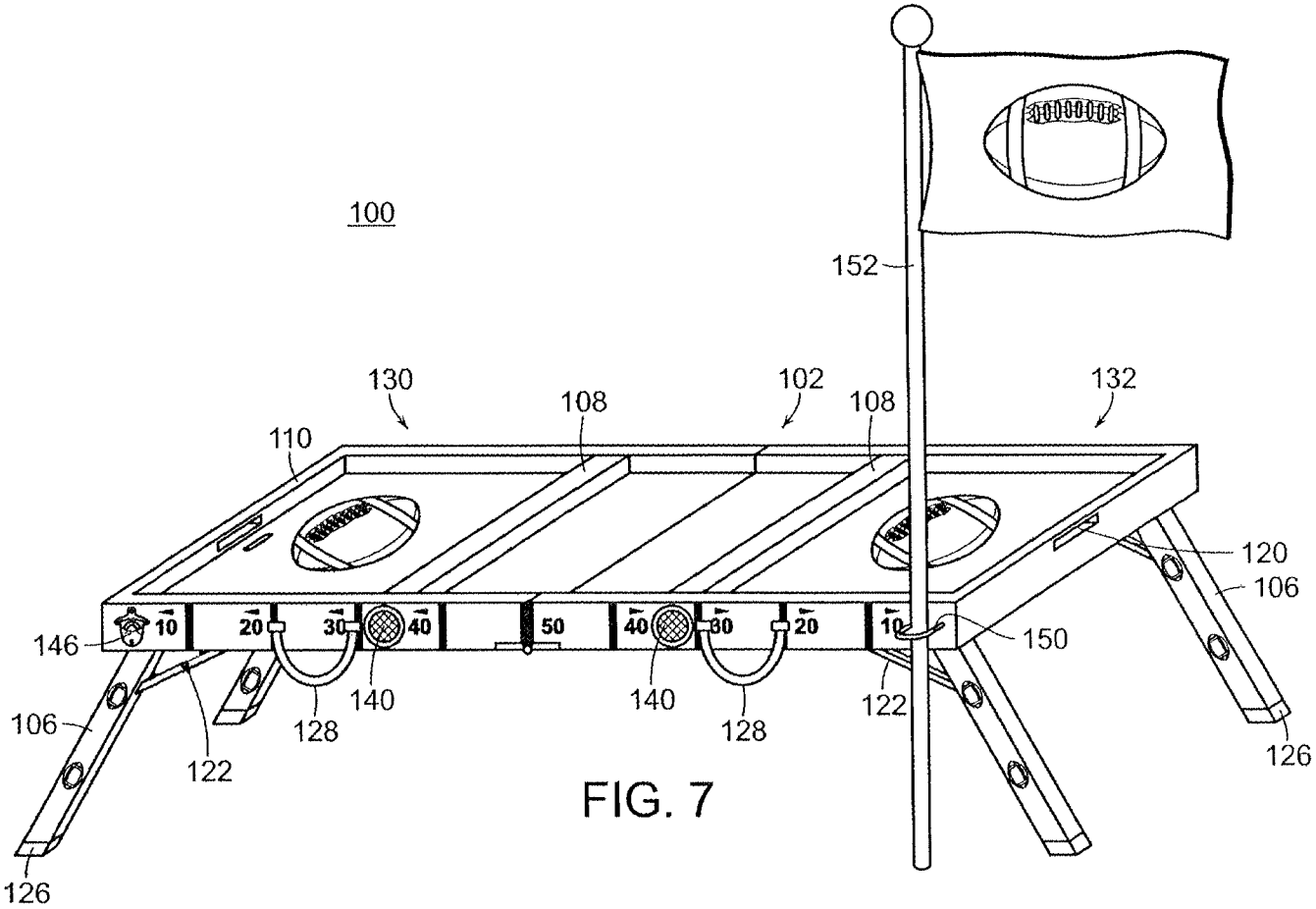
FIG. 7 is a perspective view of a second embodiment of the present invention.

Referring now to FIG. 7, there is another embodiment of the present invention. Here, the portable beverage cooler support 100 has a support base 102 with a first section 130 and a second section 132. The first section 130 and the second section 132 are coupled with at least one hinge 134. This enables the portable beverage support 100 to be transported as shown in FIG. 6B. It should be noted that, in this instance, there are no lateral members 114 (see FIG. 1) thereby making the legs independently rotatable.

The support legs 106, vertical extension 110, removable partitions 108, support base 102 may have some form of aesthetic enhancement such as textures, patterns, characters, coloration, logos, words, and the like or any combination thereof. Further, the portable beverage cooler support 100 has a flag pole holder 150 that is capable of supporting a flag pole 152. The flag pole holder 150 can accommodate any type of pole including those typically seen with umbrellas. Such an umbrella can provide shade and help keep everything contained thereunder that much more cool. Additional features may include a bottle opener 146 and storage for bottle caps or a wine opener (corkscrew) and speakers 140.

The speakers 140 may be wired or wireless and may require a power source such as a rechargeable or solid state battery. Wireless speakers may employ Bluetooth® or other appropriate wireless technology to enable a wireless connection with an electronic device capable of playing music, radio broadcasts, and the like. In some instances, the portable beverage cooler support 100 may have a dock for direct connection of the electronic device through wired means. This enables connection to a wired speaker system and may allow for charging of the electronic device via the speaker's or another power source.

Generally, the portable beverage cooler support 100 in FIGS. 1-7 has been described with holding a beverage cooler 124. However, it is within the scope of this invention and its embodiments that any number of items may be held and/or secured thereto using the principles and components described herein. Thus, the portable beverage cooler support 100 may be used to hold and/or secure virtually any object in an elevated position to limit one from having to bend over and help keep the object and surrounding area clean. Further, the portable beverage cooler support 100 may have a carrying case which can envelop and help to transport the portable beverage cooler support 100. The carrying case may have zippers, snaps, buttons, or the like and help to protect the portable beverage cooler support 100. The carrying case may further have attachment points for a carrying strap or the like to facilitate easy transportation of the portable cooler beverage support 100. Alternatively, such a carrying strap may be attached directly to the slots 120 as shown.

The portable beverage cooler support 100 and its components, as described, may be constructed from a number of materials including but not limited to plastics, metals, woods, glass, textiles, composites, rubbers, and the like or any combination thereof.

The support base 102 may be about 30 cm (12 inch) to about 122 cm (48 inch) in width and is preferably about 46 cm (18 inch) in width. The support base 102 may be about 30 cm (12 inch) to about 203 cm (80 inch) in length and is more preferably about 66 cm (26 inch) to about 133 cm (52 inch) in length. The support legs 106 may vary in their dimensions dependent on the degrees the support legs are capable of rotating from a storage position to a support position. However, it is preferable that the support legs 106 are of sufficient length to position the support base 102 about 30 cm (12 inch) to about 122 cm (48 inch) off the ground with a preferable elevated position of about 51 cm (20 inch) off the ground. Further, the support legs 106 may be height adjustable and can be adjusted depending on the needs for the given use. For example, at a children's party the legs can be lowered to make the cooler more accessible, whereas at a gathering serving primarily adults the legs can be raised to an adult can use the space more effectively.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A portable beverage cooler support comprising:

a support base configured to receive and retain at least one beverage cooler, the support base having a perimeter, a first end, a second end, and a vertical extension disposed along the perimeter, wherein the support base has a support drain located at a first end of the support base, and wherein the vertical extension contains a plurality of slots;

four support legs with two of the support legs being rotatably coupled to the support base at the first end of the support base and two of the support legs being rotatably coupled to the support base at the second end of the support base;

at least one removable partition adapted to be removably coupled to the support base, the at least one removable partition being sized to span a distance from a first side to a second side of the support base forming at least two partitioned spaces;

a removable liner sized to fit at least one of the at least two partitioned spaces;

at least one ground anchor coupled to the support base via a length of material; and at least two adjustable support straps having a first end and a second end, wherein there is a securement mechanism attached to each of the first end and the second end of the at least two support straps.

2. The portable beverage cooler support of claim 1 wherein the support base, support legs, at least one removable partition, at least two adjustable support straps, or the vertical extension or any combination thereof bears logos, characters, writing, symbols, insignia, colors, images, patterns, textures, or any combination thereof.

3. The portable beverage cooler support of claim 1 further comprising at least one carrying handle attached to the support base.

4. The portable beverage cooler support of claim 1 wherein the support base has a first section and a second section, the first section and the second section being hingeably coupled to one another.

5. The portable beverage cooler support of claim 1, wherein the securement mechanism of the adjustable support straps is coupled to one of the plurality of slots.

6. A portable beverage cooler support system comprising:

a beverage cooler support comprising, a support base having a perimeter and a first end, a second end, a first section, and a second section, wherein the support base has at least one support drain, and wherein the first section is hingeably coupled to the second section;

four support legs with two of the support legs being coupled to the support base at the first end of the support base and two of the support legs being coupled to the support base at the second end of the support base;

at least one removable partition adapted to be removably coupled to the support base;

a plurality of ground anchors coupled to the support base via a length of material, wherein one ground anchor is coupled to each of the vertices of the support base;

at least two adjustable support straps having a first end and a second end, wherein there is a securement mechanism attached to each of the first end and the second end of the at least two support straps;

a vertical extension extending wholly around the perimeter of the support base;

at least one wireless speaker; and at least one beverage cooler, wherein the at least one beverage cooler is retained to the beverage cooler support via at least two support straps, wherein a first end of each of the two support straps is coupled to the beverage cooler support, and wherein a second end of each of the two support straps is coupled to the beverage cooler.

7. The system of claim 6 further comprising a bottle opener disposed on the support base.

8. The system of claim 6 further comprising a pole holder coupled to an outer surface of the support base.

9. The system of claim 6 wherein the supports legs are independently rotatable.

* * * * *